US008474885B2

(12) United States Patent
Lu et al.

(10) Patent No.: US 8,474,885 B2
(45) **Date of Patent: *Jul. 2, 2013**

(54) FIRE DOOR LOCK STRUCTURE AND LATCH ASSEMBLY THEREOF

(75) Inventors: Shih-Min Lu, Ziguan Township, Kaohsiung County (TW); Fu-Chih Huang, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 203 days.

This patent is subject to a terminal disclaimer.

(21) Appl. No.: 13/094,025

(22) Filed: Apr. 26, 2011

(65) Prior Publication Data

US 2011/0198869 A1 Aug. 18, 2011

Related U.S. Application Data

(63) Continuation-in-part of application No. 12/216,644, filed on Jul. 9, 2008, now abandoned.

(51) Int. Cl.
*E05C 3/06* (2006.01)

(52) U.S. Cl.
USPC ..... 292/195; 292/93

(58) Field of Classification Search
USPC ..... 292/92, 93, 195; 70/102, 106, 107, 70/110, 92
See application file for complete search history.

(56) References Cited

U.S. PATENT DOCUMENTS

| | | | | |
|---|---|---|---|---|
| 4,709,950 | A * | 12/1987 | Zortman | 292/92 |
| 4,796,931 | A * | 1/1989 | Heid | 292/92 |
| 5,219,385 | A * | 6/1993 | Yeh | 70/92 |
| 6,009,732 | A * | 1/2000 | Haeck et al. | 70/92 |
| 7,896,407 | B2 * | 3/2011 | Di Vinadio | 292/92 |
| 2007/0246947 | A1 * | 10/2007 | Banks et al. | 292/93 |
| 2011/0198871 | A1 * | 8/2011 | Lu et al. | 292/220 |
| 2012/0256428 | A1 * | 10/2012 | Tien | 292/92 |

FOREIGN PATENT DOCUMENTS

TW 568160 A1 12/2003

* cited by examiner

*Primary Examiner* — Gary Estremsky
(74) *Attorney, Agent, or Firm* — Jackson IPG PLLC

(57) ABSTRACT

A fire door lock structure includes a stopper disposed at a door frame and a latch assembly disposed at a fire door, wherein the latch assembly comprises a lock base, a latch unit, a blocking member, a pair of male and female means and a linking set. The latch unit includes a latch bolt. The latch unit and the blocking member are swingably disposed at an accommodating slot of the lock base. The blocking member is fastened at the stopper by the pair of male and female means, wherein the male means comprises a fastener formed at the blocking member. In the locked state, the fastener of the male means can be fastened at the stopper to prevent the stopper from being unable to block the latch bolt caused by a deformed fire door or deformed door frame under a fire condition.

20 Claims, 10 Drawing Sheets

FIRE DOOR LOCK STRUCTURE AND LATCH ASSEMBLY THEREOF

CROSS REFERENCE TO RELATED APPLICATIONS

This application is a Continuation-in-Part of application Ser. No. 12/216,644 filed on Jul. 9, 2008 now abandoned, and for which priority is claimed under 35 U.S.C. §120, the entire contents of which are hereby incorporated by reference.

FIELD OF THE INVENTION

The present invention is generally relating to a fire door lock structure, wherein a fastener of a latch assembly disposed at a fire door is fastened at a stopper of a door frame to prevent the stopper from being unable to block a latch bolt of the latch assembly via deformed fire door or deformed door frame under a fire condition.

BACKGROUND OF THE INVENTION

Taiwan patent publication No. 568160 disclosed that a "structure of fireproof doors" is relevant to a fire door lock. Two latch bolts are disposed at an upper end and a lower end of a fire door separately, and the latch bolts can be blocked by two stoppers disposed at a door frame therefore forming a locked state. Usually, the blocked latch bolts departs from the stoppers and leads to an unlocked state via the actuation of a main lock. With reference to FIG. 1, a fire door lock comprises a stopper 20 disposed at a door frame 10 and a latch 40 disposed at a fire door 30. A latch bolt 41 of the latch 40 can be blocked by the stopper 20 to prevent the fire door 30 from being opened therefore possessing burglarproof and fireproof functions. With reference to FIG. 2, the latch bolt 41 disposed at the fire door 30 merely blocks the stopper 20 disposed at the door frame 10, once a fire occurred, the fire would burn and deform the door frame 10 or the fire door 30. Accordingly, the stopper 20 cannot block the latch bolt 41 of the latch 40 disposed at deformed fire door 30. Therefore, the fireproof function of the fire door 30 would be all lost.

SUMMARY

The primary object of the present invention is to provide a fire door lock structure comprising a stopper disposed at a door frame and a latch assembly disposed at a fire door, wherein the latch assembly comprises a lock base, a latch unit, a blocking member, a pair of male and female means and a linking set. The latch unit comprises a latch bolt. The latch unit and the blocking member are swingably disposed at an accommodating slot of the lock base. The blocking member is fastened at the stopper by the pair of male and female means, wherein the male means comprises a fastener formed at the blocking member. In the locked state, the fastener of the male means can be fastened at the stopper to prevent the stopper from being unable to block the latch bolt caused by a deformed fire door or deformed door frame under a fire condition.

Additionally, an accommodating space can be defined between the blocking member and the latch bolt, and the stopper can be fitted in the accommodating space. The stopper comprises a rear surface adjacent to the fire door and a front surface opposite to the rear surface. The female means comprises an accommodating portion formed at the rear surface and the fastener can be fastened into the accommodating portion.

DETAILED DESCRIPTION OF THE INVENTION

Figure 1:
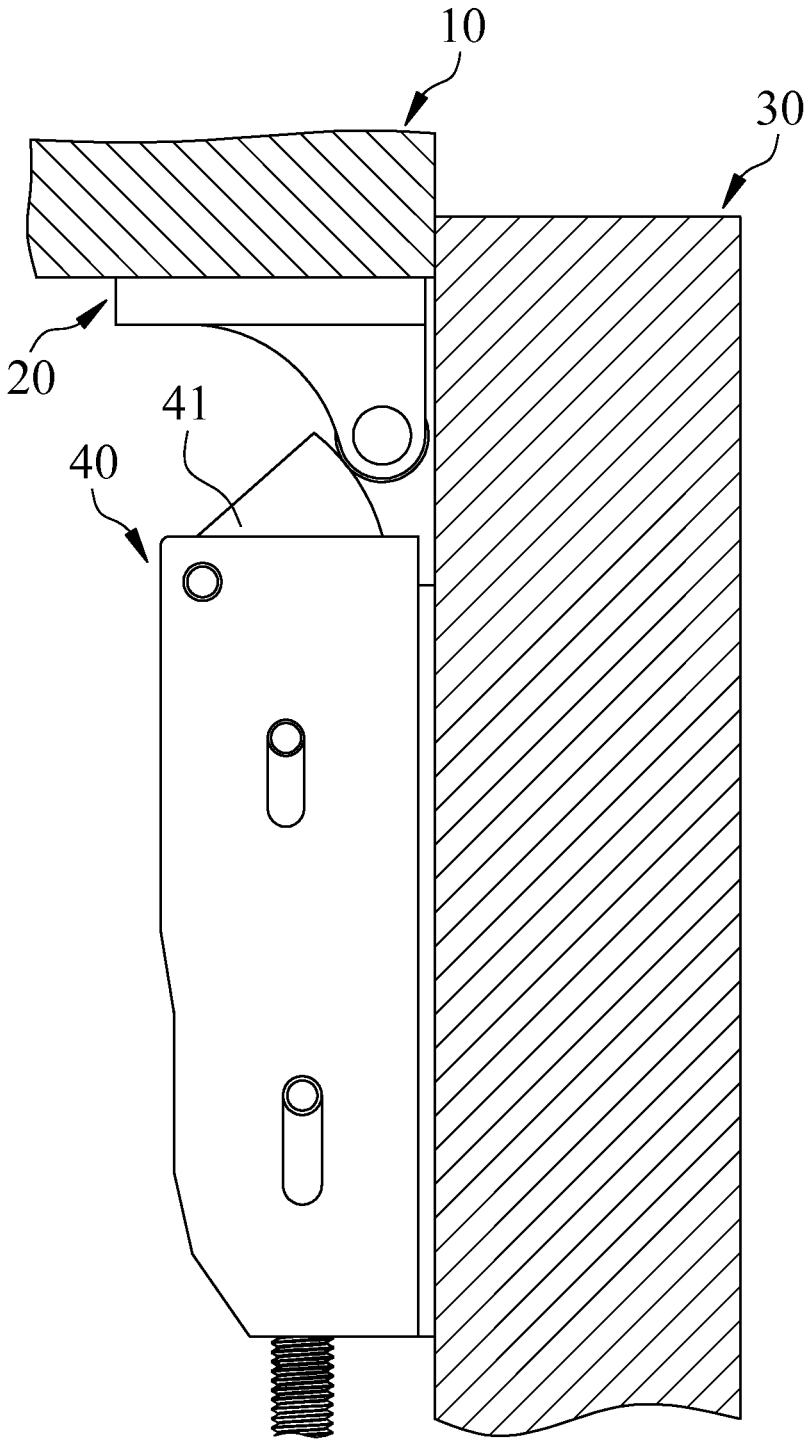
FIG. 1 PRIOR ART
FIG. 1 is a schematic diagram illustrating a locked state formed between a latch bolt and a stopper of conventional fire door lock.
Figure 2:
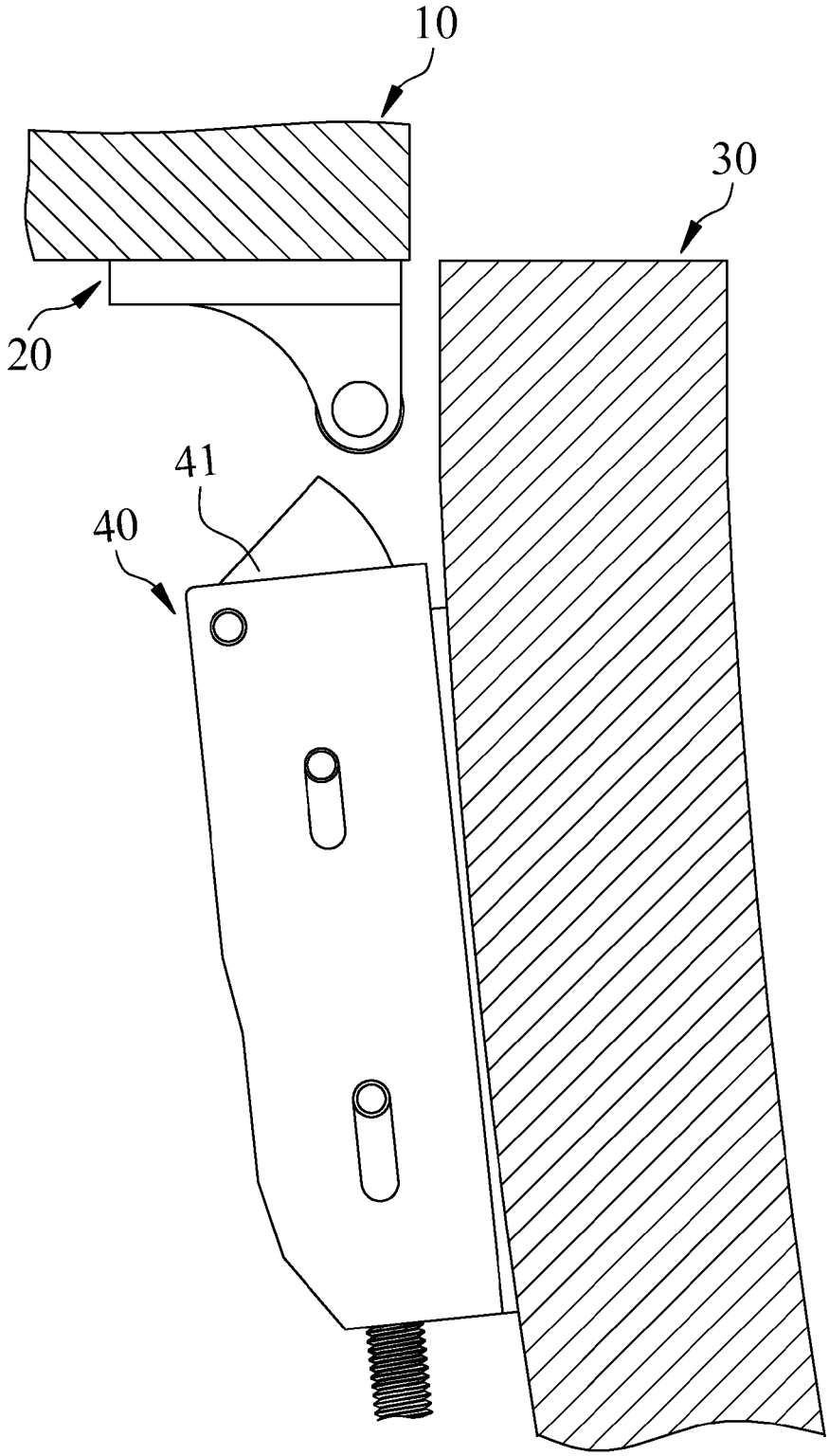
FIG. 2 PRIOR ART
FIG. 2 is a schematic diagram illustrating an unlock situation formed between the latch bolt and the stopper of conventional fire door lock.
Figure 3:
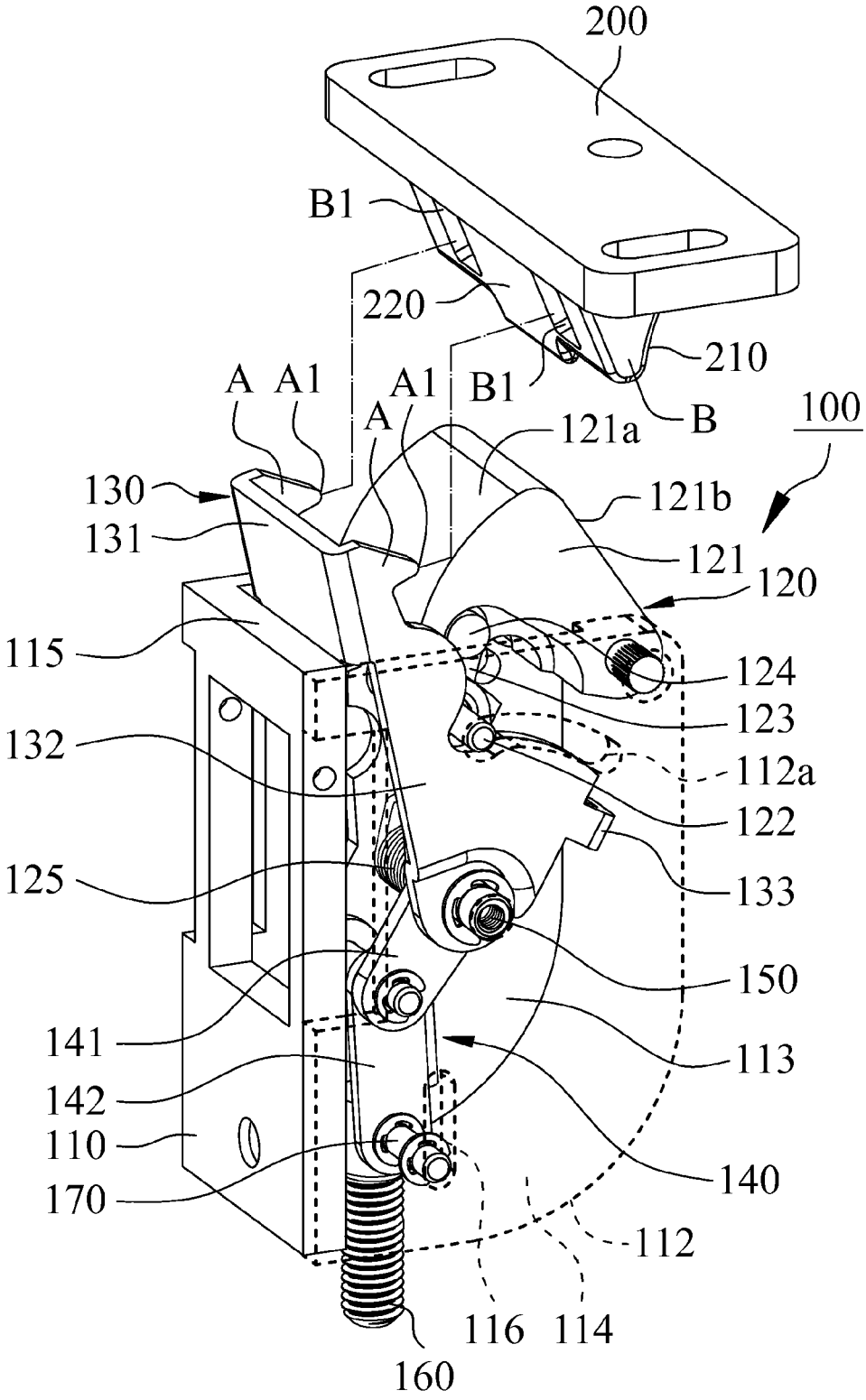
FIG. 3 is a perspective exploded view illustrating a latch assembly and a stopper of fire door lock structure in accordance with a preferred embodiment of the present invention.
Figure 4:
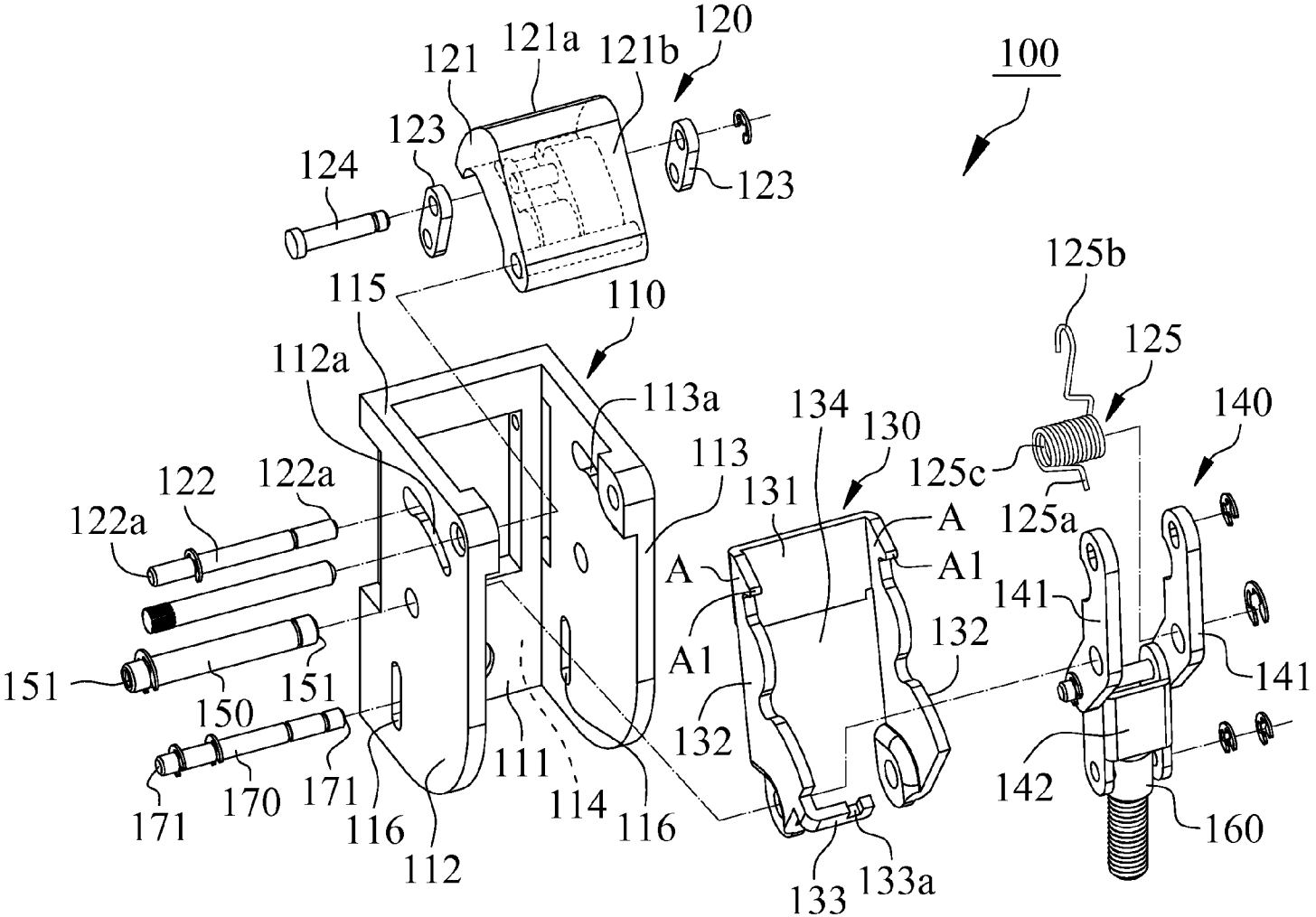
FIG. 4 is a perspective exploded view illustrating the latch assembly in accordance with a preferred embodiment of the present invention.
Figure 5:
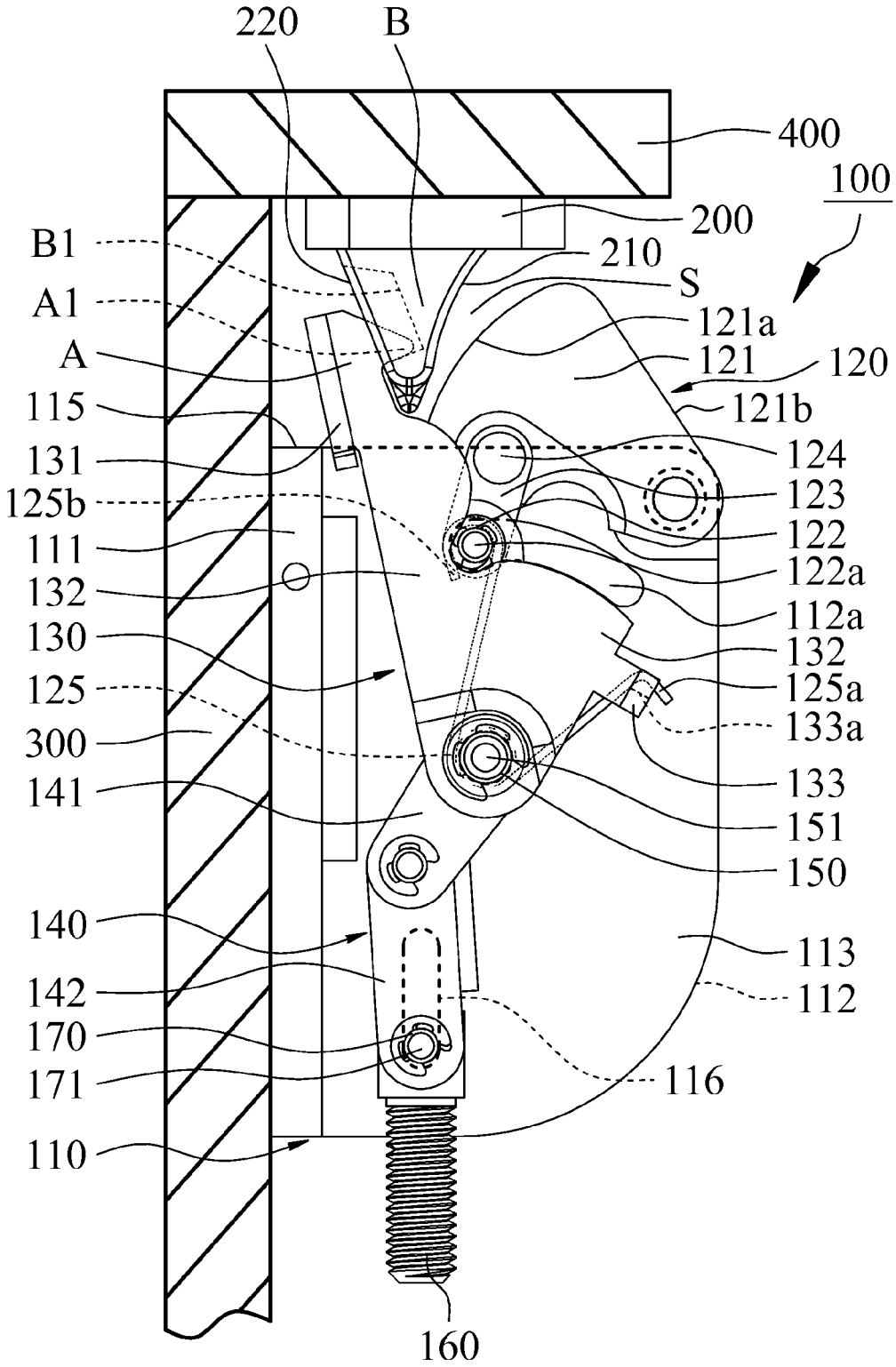
FIG. 5 is a lateral section view illustrating a locked state formed between the latch assembly and the stopper in accordance with a preferred embodiment of the present invention.

With reference to FIGS. 3, 4 and 5, a fire door lock structure in accordance with a preferred embodiment of the present invention comprises a latch assembly 100 disposed at a fire door 300 and a stopper 200 disposed at a door frame 400, wherein the latch assembly 100 can be fastened with the stopper 200. The latch assembly 100 comprises a lock base 110, a latch unit 120, a blocking member 130, a pair of male and female means A, B and a linking set 140. The lock base 110 comprises a bottom portion 111, a first lateral portion 112, a second lateral portion 113 opposite to the first lateral portion 112, a top portion 115 and an accommodating slot 114 defined by the bottom portion 111, the first lateral portion 112 and the second lateral portion 113, wherein the bottom portion 111 of the lock base 110 is disposed at the fire door 300. The latch unit 120 comprises a latch bolt 121 having a blocking surface 121*a* and a limiting surface 121*b* in communication with the blocking surface 121*a*. The latch bolt 121 can be blocked by the stopper 200. The latch bolt 121 and the blocking member 130 are swingably disposed at the accommodating slot 114 of the lock base 110. The blocking member 130 comprises a main body 131, at least one lateral body 132 protruded to the main body 131, a contacting portion 133 and a restricted slot 134 positioned beneath the main body 131. The blocking member 130 is fastened at the stopper 200 by the pair of male and female means A, B. In this embodiment, the stopper 200 of the door frame 400 comprises a rear surface 220 adjacent to the fire door 300 and a front surface 210 opposite to the rear surface 210, the female means B comprises an accommodating portion B1 formed at the rear surface 210. The male means A comprises a fastener A1 formed at the blocking member 130, the fastener A1 can be fastened at the accommodating portion B1, wherein the fastener A1 of the male means A and the contacting portion 133 are formed at the lateral body 132.

The quantity of mentioned lateral body 132 and the male means A are two separately. A length of the main body 131 is smaller than that of the lateral body 132 to lead an incomplete connection between the main body 131 and the lateral body 132 therefore forming the restricted slot 134. The fastener A1 is protruded to the top portion 115 of the lock base 110. The contacting portion 133 can be a cantilever. The cantilever is protruded to the lateral body 132 and faces toward the second lateral portion 113. When the latch bolt 121 projects from the accommodating slot 114 of the lock base 110, an accommodating space S can be defined between the blocking member 130 and the latch bolt 121, and the stopper 200 can be fitted inside the accommodating space S to enable the fastener A1 to fasten with the stopper 200. In this embodiment, the latch unit 120 further comprises an elastic member 125. The elastic member 125 is disposed at the accommodating slot 114 of the lock base 110 and comprises a first end 125*a*. Besides, the elastic member 125 can be a torsion spring. The first end 125*a* is coupled to the contacting portion 133 of the blocking member 130. In this embodiment, a recess 133*a* is recessed into the cantilever of the blocking member 130, and the first end 125*a* is fastened to the recess 133*a*. The blocking member 130 is actuated by elasticity of the elastic member 125 to enable the fastener A1 to fasten with the stopper 200. The linking set 140 is pivotally connected with the latch unit 120 and disposed at the accommodating slot 114.

With reference to FIGS. 3, 4 and 5, the latch unit 120 further comprises a combining pin 122, two actuating boards 123 and a penetrating bolt 124. The penetrating bolt 124 is penetrated through the actuating boards 123 and the latch bolt 121 to form a mutual link between the actuating boards 123 and the latch bolt 121. In addition, the combining pin 122 comprises two end portions 122*a*, the first lateral portion 112 of the lock base 110 comprises a first sliding slot 112*a*, and the second lateral portion 113 of the lock base 110 comprises a second sliding slot 113*a*. Each of the end portions 122*a* is limited within the first sliding slot 112*a* and the second sliding slot 113*a* separately. The linking set 140 comprises a first linking member 141 and a second linking member 142 pivotally connected with the first linking member 141. The combining pin 122 is pivotally connected with the first linking member 141 of the linking set 140 and the actuating boards 123 of the latch unit 120. When the combining pin 122 is actuated by the first linking member 141 of the linking set 140, the latch bolt 121 can be driven by the combining pin 122 simultaneously. Therefore, the latch bolt 121 may project from the accommodating slot 114 of the lock base 110.

Further, the latch assembly 100 of the fire door lock structure further comprises a fixing rod 150 having two terminals 151, and the fixing rod 150 is pivotally connected with the lateral body 132 of the blocking member 130 and the first linking member 141 of the linking set 140. Each of the terminals 151 is coupled to the first lateral portion 112 and the second lateral portion 113 respectively, and the blocking member 130 is swingable via the fixing rod 150 serving as a shaft. The elastic member 125 further comprises a second end 125*b* and a barrel portion 125*c* disposed around the fixing rod 150, and the second end 125*b* is coupled to the combining pin 122 of the latch unit 120. Additionally, the latch assembly 100 of the fire door lock structure further comprises a linking rod 160 and a pivoting rod 170, and the linking rod 160 is pivotally connected with the second linking member 142 via the pivoting rod 170. The first lateral portion 112 and the second lateral portion 113 of the lock base 110 comprise a longitudinal sliding slot 116 respectively, the pivoting rod 170 comprises two tips 171, and each of the tips 171 is slidably disposed at each of the longitudinal sliding slots 116.

Figure 6:
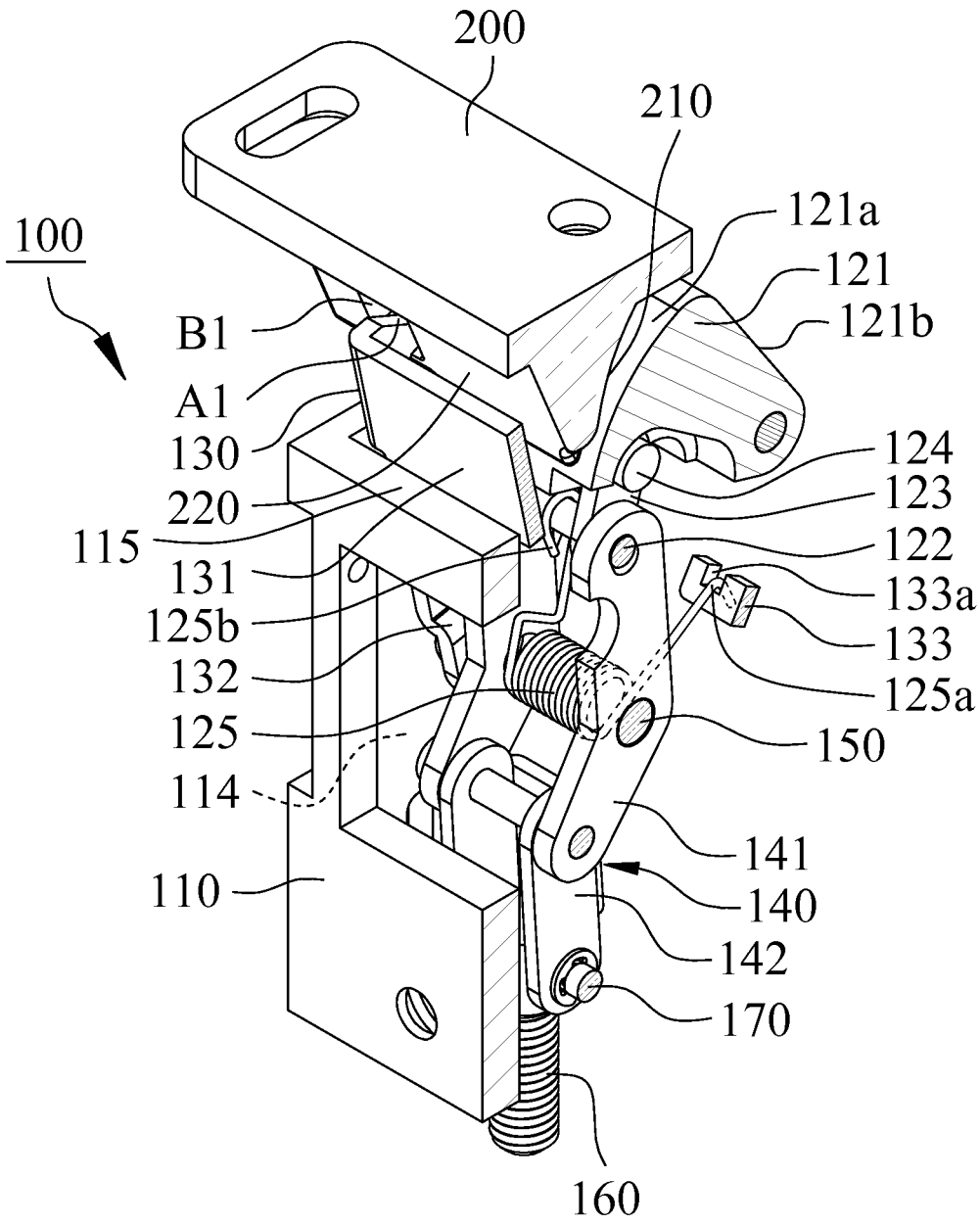
FIG. 6 is a perspective section view illustrating a locked state formed between the latch assembly and the stopper in accordance with a preferred embodiment of the present invention.
Figure 7:
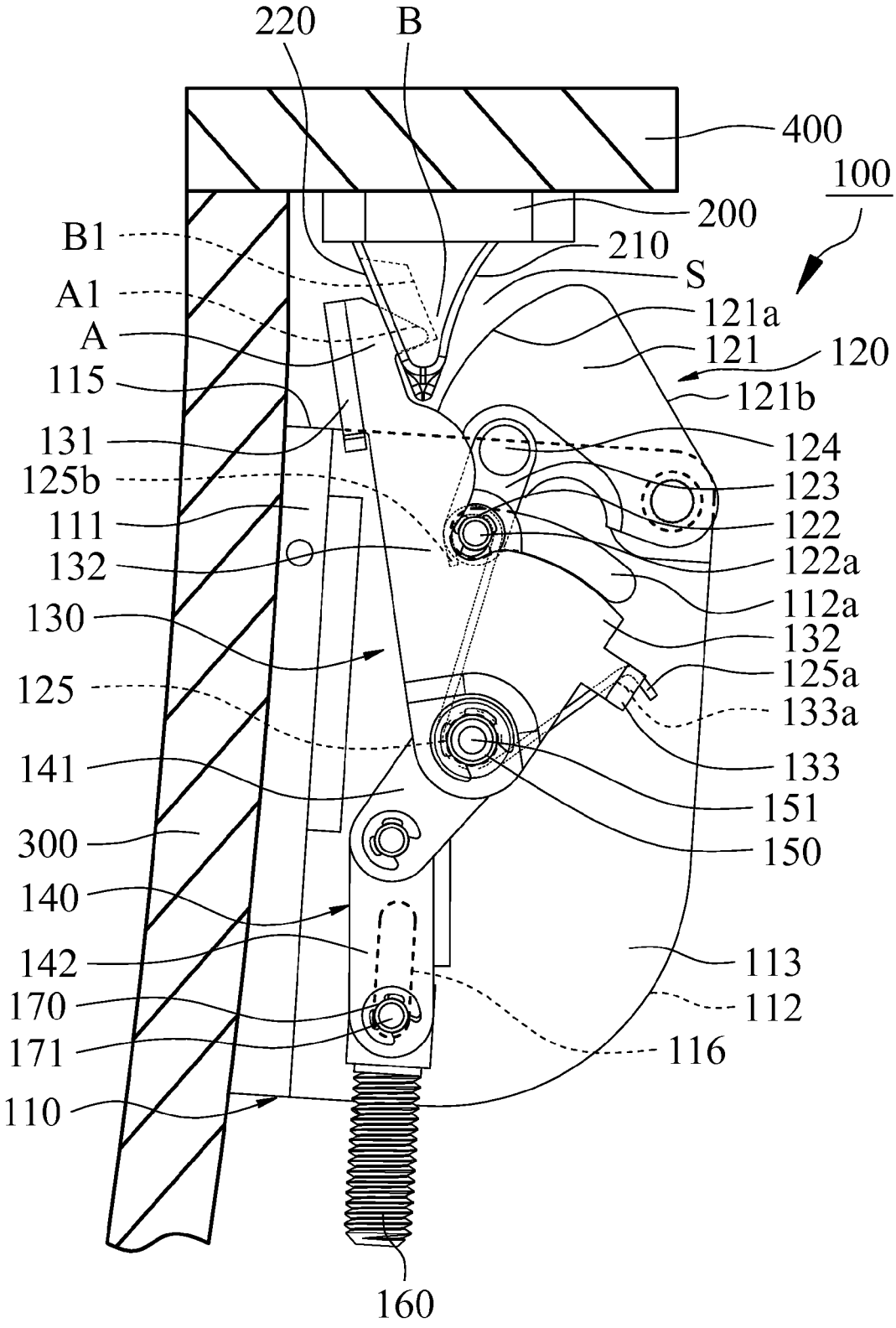
FIG. 7 is a lateral section view illustrating a locked state formed between the stopper and the latch assembly disposed at deformed fire door in accordance with a preferred embodiment of the present invention.

With reference to FIGS. 5 and 6, FIG. 5 and FIG. 6 illustrate a normally locked state of the fire door 300, wherein the bottom portion 111 of the lock base 111 is disposed at the fire door 300. The latch bolt 121 of the latch unit 120 is protruded to the lock base 110, and the stopper 200 is located between the latch bolt 121 and the blocking member 130. In this embodiment, the blocking surface 121*a* is utilized for contacting against the front surface 210 of the stopper 200. Therefore, the latch bolt 121 can be blocked by the stopper 200 to prevent the fire door 300 from being opened. Firmly fastened relationship between the stopper 200 and the latch bolt 121 may prevent the stopper 200 from being unable to block the latch bolt 121 via deformed fire door 300 or deformed door frame 400 under a fire condition. Referring to FIG. 7, owing to deformed fire door 300, the relative position between the latch bolt 121 and the front surface 210 of the stopper 200 might be changed, but the fastener A1 is still fastened at the accommodating portion B1. Accordingly, the locked state of the fire door 300 can be remained, and the flame will be restrained by the fire door 300 under fire condition to achieve a fireproof function.

Furthermore, the accommodating portion 221 is formed inside the stopper 200. When the fastener A1 is fastened at the accommodating portion B1, a big contact area between the blocking member 130 and the accommodating portion B1 is generated to increase overall friction force to avoid the fastener A1 to be departed from the stopper 200. Therefore, the fire door 300 is steadily maintained in the locked state.

When the latch bolt 121 projects from the lock base 110, the combining pin 122 of the latch unit 120 is positioned far from the contacting portion 133 of the blocking member 130. Besides, for the reason that the contacting portion 133 of the blocking member 130 is pressed by the first end 125*a* of the elastic member 125 and the second end 125*b* of the elastic member 125 is coupled by the combining pin 122 of the latch unit 120, the elastic member 125 can be formed into a stretched state. The stretched elastic member 125 may generate an elasticity to pull the blocking member 130 back to the direction of the latch bolt 121. Accordingly, the fastener A1 can be firmly fastened at the accommodating portion B1 to enable the fire door 300 to be firmly maintained in the locked state.

Figure 8:
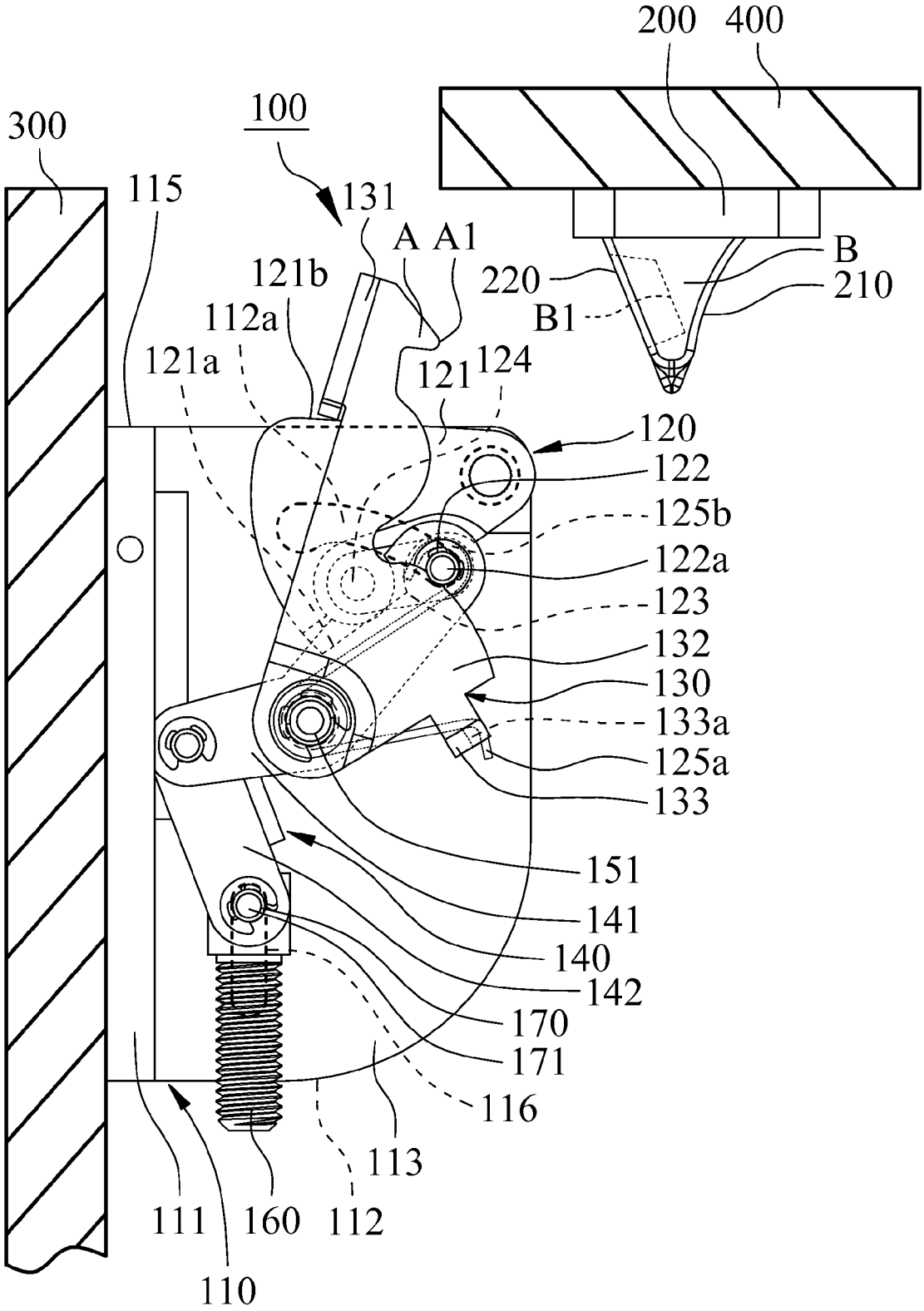
FIG. 8 is a lateral section view illustrating an unlocked state formed between the latch assembly and the stopper in accordance with a preferred embodiment of the present invention.
Figure 9:
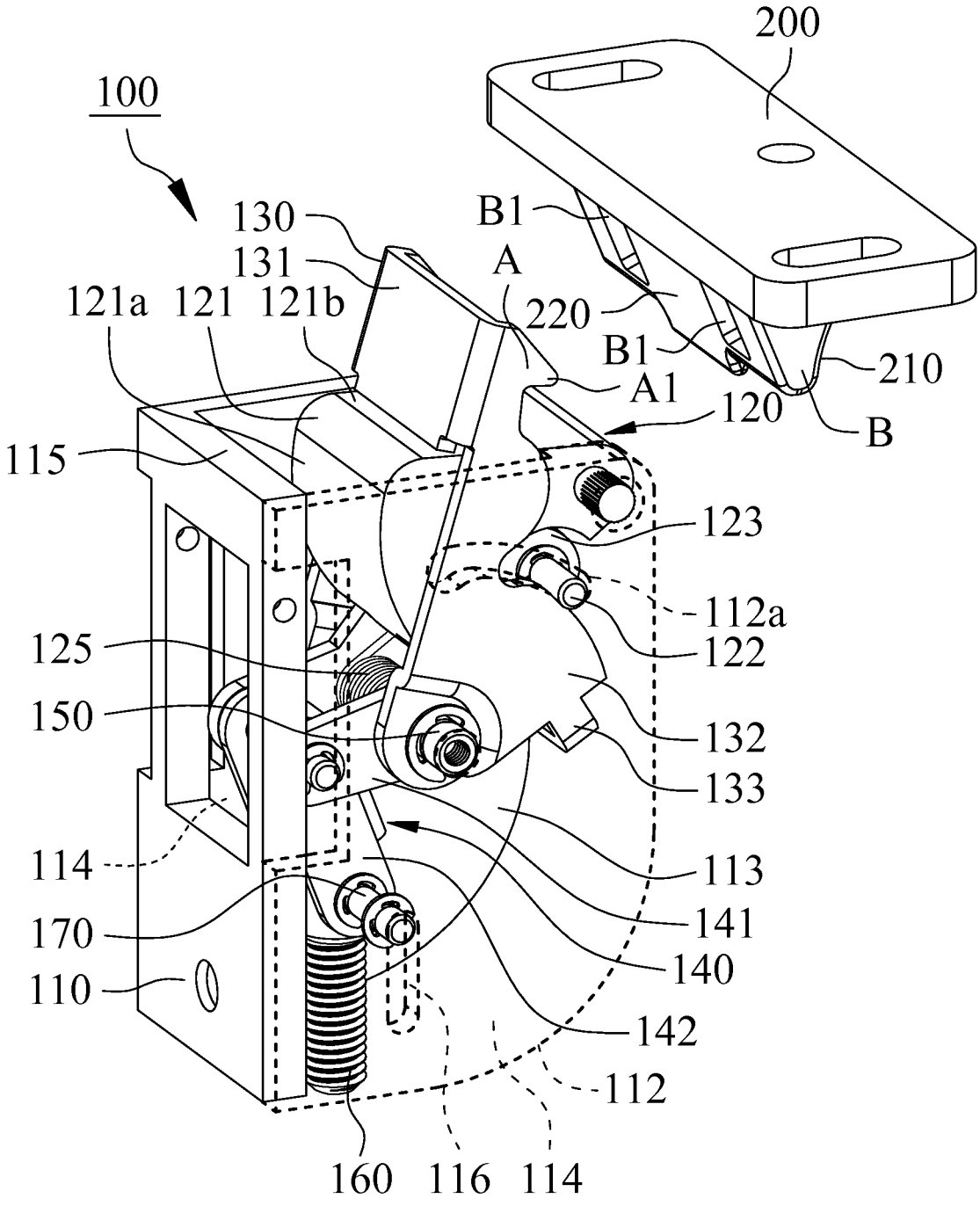
FIG. 9 is a perspective assembly view illustrating an unlocked state formed by the latch assembly of fire door lock structure in accordance with a preferred embodiment of the present invention.
Figure 10:
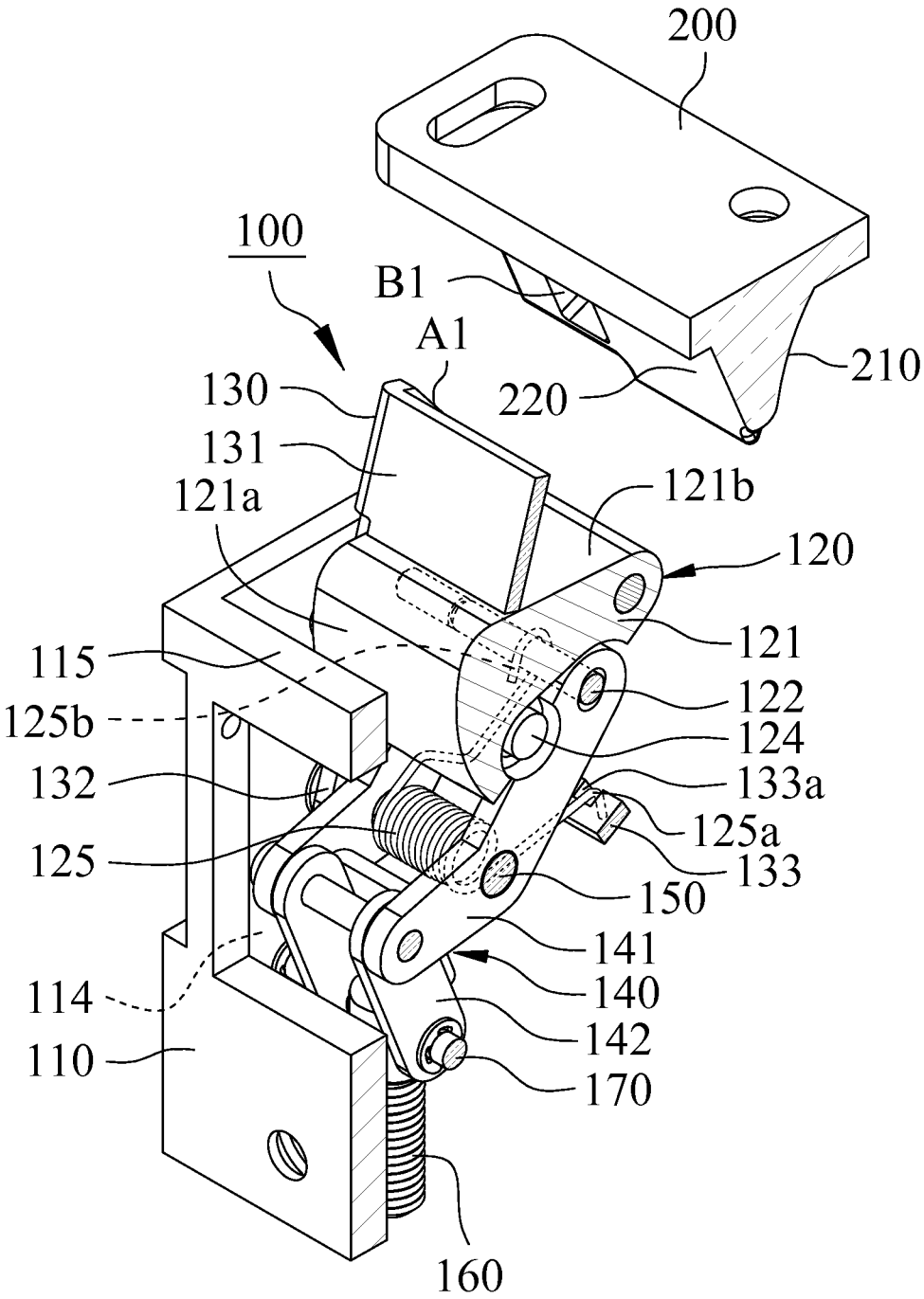
FIG. 10 is a perspective section view illustrating an unlocked state formed by the latch assembly of fire door lock structure in accordance with a preferred embodiment of the present invention.

With reference to FIG. 8, FIG. 8 illustrates a normally unlocked state for an unfastened condition between the latch assembly 100 of fire door lock and the stopper 200. Referring to FIGS. 8, 9 and 10, the pivoting rod 170 can be driven by the linking rod 160 to move upwardly along each of the longitudinal sliding slots 116, in the meantime, the second linking member 142 of the linking set 140 is driven by the pivoting rod 170 to pivot toward the bottom portion 111 of the lock base 110. Besides, the first linking member 141 is pivotally connected with the second linking member 142 to enable the first linking member 141 to swing via the fixing rod 150 serving as a shaft. Due to the interconnection between the combining pin 122, the first linking member 141 of the linking set 140 and the actuating boards 123 of the latch unit 120 and the movement limitation of the combining pin 122 within the first sliding slot 112*a* and the second sliding slot 113*a*, when the combining pin 122 is actuated by the first linking member 141, the combining pin 122 moves outwardly along the first sliding slot 112*a* and the second sliding slot 113*a*, and the actuating boards 123 can be actuated by the combining pin 122 at the same time. Therefore, the latch bolt 121 can be actuated by the actuating boards 123 to retract into the lock base 110.

With the outward movement of the combining pin 122 along with the first sliding slot 112*a* and the second slot 113*a*, the blocking member 130 cannot be limited by the combining pin 122. The elasticity of the elastic member 125 enables the blocking member 130 to swing toward the latch bolt 121 via the fixing rod 150 serving as a shaft. Furthermore, the latch bolt 121 is fitted into the restricted slot 134 of the blocking member 130, and the main body 131 of the blocking member 130 contacts against the limiting surface 121*b* of the latch bolt 121. In this embodiment, the limiting surface 121*b* can be blocked by the blocking member 130 to prevent the latch bolt 121 from projection. When the state of the fire door 300 is changed from the unlocked state to the locked state, the blocking member 130 props against the stopper 200 to enable the latch bolt 121 to depart from the restricted slot 134 of the blocking member 130. Eventually, the latch bolt 121 is protruded to the lock base 110, and the stopper 200 is located between the latch bolt 121 and the blocking member 130 to form a normally locked state.

In this invention, when the fire door lock structure is situated in the locked state, the fastener A1 can be firmly fastened at the accommodating portion B1. When the fire door 300 or the door frame 400 are deformed via burning under a fire condition, the locked state of the fire door lock structure can be still maintained to prevent the fire door 300 from being opened.

While this invention has been particularly illustrated and described in detail with respect to the preferred embodiments thereof, it will be clearly understood by those skilled in the art that is not limited to the specific features shown and described and various modifications and changes in form and details may be made without departing from the spirit and scope of this invention.

What is claimed is:

1. A latch assembly of a fire door lock structure for fastening with a stopper disposed at a door frame wherein the latch assembly comprises:

a lock base having a bottom portion, a first lateral portion, a second lateral portion and an accommodating slot defined by the bottom portion, the first lateral portion and the second lateral portion;

a latch unit having a latch bolt, wherein the latch bolt is swingably disposed at the accommodating slot of the lock base and blockable by the stopper;

a blocking member swingably disposed at the accommodating slot of the lock base;

a male structure and a female structure, wherein the blocking member is fastened at the stopper by the male structure and the female structure; and a linking set pivotally connected at the latch unit.

2. The latch assembly of a fire door lock structure in accordance with claim 1, wherein the female structure comprises an accommodating portion formed at the stopper, and wherein the male structure comprises a fastener formed at the blocking member, and the fastener is fastenable at the accommodating portion.

3. The latch assembly of a fire door lock structure in accordance with claim 1, further comprising a fixing rod having two terminals, wherein the fixing rod is pivotally connected with the blocking member and the linking set, each of the terminals is coupled to the first lateral portion and the second lateral portion respectively, and the blocking member is swingable via the fixing rod.

4. The latch assembly of a fire door lock structure in accordance with claim 1, wherein when the latch bolt projects from the accommodating slot of the lock base, an accommodating space is defined between the blocking member and the latch bolt, and the stopper is fitted inside the accommodating space.

5. The latch assembly of a fire door lock structure in accordance with claim 1, wherein the latch bolt comprises a limiting surface capable of being blocked by the blocking member to prevent the latch bolt from projection.

6. The latch assembly of a fire door lock structure in accordance with claim 2, wherein the lock base further comprises a top portion and the fastener is protruded to the top portion.

7. The latch assembly of a fire door lock structure in accordance with claim 2, wherein the blocking member comprises a main body and at least one lateral body protruded to the main body, and the fastener is formed at the lateral body.

8. The latch assembly of a fire door lock structure in accordance with claim 7, wherein the blocking member further comprises a contacting portion formed at the lateral body.

9. The latch assembly of a fire door lock structure in accordance with claim 8, wherein the contacting portion is a cantilever protruded to the lateral body.

10. The latch assembly of a fire door lock structure in accordance with claim 9, wherein the latch unit further comprises an elastic member and a combining pin, wherein the latch bolt is driveable by the combining pin, the elastic member is disposed at the accommodating slot of the lock base, the elastic member comprises a first end and a second end, wherein the first end is coupled to the contacting portion of the blocking member, and the second end is coupled to the combining pin of the latch unit.

11. A fire door lock structure comprising:

a stopper disposed at a door frame; and a latch disposed at a fire door, the latch comprising:

a lock base having a bottom portion, a first lateral portion, a second lateral portion and an accommodating slot defined by the bottom portion, the first lateral portion and the second lateral portion;

a latch unit having a latch bolt, wherein the latch unit is swingably disposed at the accommodating slot of the lock base and blockable by the stopper;

a blocking member swingably disposed at the accommodating slot of the lock base;

a male structure and a female structure, wherein the blocking member is fastened at the stopper by the male structure and the female structure; and a linking set pivotally connected at the latch unit.

12. The fire door lock structure in accordance with claim 11, wherein the female structure comprises an accommodating portion formed at the stopper, and wherein the male structure comprises a fastener formed at the blocking member, and the fastener is fastenable at the accommodating portion.

13. The fire door lock structure in accordance with claim 11, further comprising a fixing rod having two terminals, wherein the fixing rod is pivotally connected with the blocking member and the linking set, each of the terminals is coupled with the first lateral portion and the second lateral portion respectively, and the blocking member is swingable via the fixing rod.

14. The fire door lock structure in accordance with claim 11, wherein the latch bolt projects from the accommodating slot of the lock base, an accommodating space is defined between the blocking member and the latch bolt, and the stopper is fitted inside the accommodating space.

15. The fire door lock structure in accordance with claim 11, wherein the latch bolt further comprises a limiting surface capable of being blocked by the blocking member to prevent the latch bolt from projection.

16. The fire door lock structure in accordance with claim 12, wherein the lock base further comprises a top portion and the fastener is protruded to the top portion.

17. The fire door lock structure in accordance with claim 12, wherein the blocking member comprises a main body and at least one lateral body protruded to the main body, and the fastener is formed at the lateral body.

18. The fire door lock structure in accordance with claim 17, wherein the blocking member further comprises a contacting portion formed at the lateral body.

19. The fire door lock structure in accordance with claim 18, wherein the contacting portion is a cantilever and wherein the cantilever is protruded to the lateral body.

20. The fire door lock structure in accordance with claim 19, wherein the latch unit further comprises an elastic member and a combining pin, the latch bolt is driveable by the combining pin, the elastic member is disposed at the accommodating slot of the lock base, the elastic member comprises a first end and a second end, the first end is coupled to the contacting portion of the blocking member, and the second end is coupled to the combining pin of the latch unit.

* * * * *